United States Patent [19]

Woloszczuk

[11] Patent Number: 4,983,987

[45] Date of Patent: Jan. 8, 1991

[54] ANTENNA

[75] Inventor: Edmund W. Woloszczuk, Essex, United Kingdom

[73] Assignee: The General Electric Company, p.l.c., London, United Kingdom

[21] Appl. No.: 286,844

[22] Filed: Dec. 20, 1988

[51] Int. Cl.[5] ..... H01Q 21/24

[52] U.S. Cl. ..... 343/797; 343/795; 343/905

[58] Field of Search ..... 343/797, 795, 810, 816, 343/820, 821, 829, 830, 905

[56] References Cited

U.S. PATENT DOCUMENTS 3,742,510 6/1973 Spanos ..... 343/730

FOREIGN PATENT DOCUMENTS 156684 10/1985 European Pat. Off. .
1480377 7/1977 United Kingdom ..... 343/797
2048571 12/1980 United Kingdom ..... 343/797
2191044 12/1987 United Kingdom .
2207005 1/1989 United Kingdom .

*Primary Examiner*—Michael C. Wimer
*Attorney, Agent, or Firm*—Spencer & Frank

[57] ABSTRACT

An antenna capable of producing circularly polarized radiation is formed by two non-coaxial cross dipoles.

5 Claims, 2 Drawing Sheets

ANTENNA

FIELD OF THE INVENTION

This invention relates to Antennas formed by Triplate fed, crossed, dipoles.

DESCRIPTION OF THE PRIOR ART

Such dipoles have in the past been formed by two perpendicularly crossed coaxial dipoles, where the axis of a dipole is defined as the line bisecting the dipole and being perpendicular to the E-plane. The dipoles are each linked to a Triplate feed structure that is, a feed structure having two outer conductors and a signal-carrying central conductor. A problem with this coaxial arrangement is that if circularly polarized radiation is to be transmitted or received by the antenna it is impossible to prevent interference or "crosstalk" between the two dipoles thus, resulting in noise and loss of circularity in the signal.

Another problem with conventional Triplate fed crossed dipoles is that each dipole must be electrically linked to the central conductor of its respective Triplate by a coaxial cable because if it were attempted to connect the dipoles to the central conductor directly, electrical interference between the two central conductors would be unacceptably high due to the small separation of the two central conductors. This use of coaxial cables is a significant addition to the cost of manufacturing the antenna.

One way in which it has been proposed to solve these problems is shown in our co-pending British patent application Ser. No. 8,612,907 which is now British Pat. No. 2,191,044. In this method, separate perpendicular dipoles are dispersed in an array. Although this largely removes the problems of cross talk, the resulting array is physically very large and bulky and thus, unsuitable for some applications.

Additionally, there is a loss of circularity in any signal that is not perpendicular to the array.

BRIEF SUMMARY OF THE INVENTION

This invention provides an antenna comprising a pair of three conductor (Triplate) fed, crossed dipoles, the two dipoles being non-coaxial and having their center axes separated by less than the length of their dipole arms.

An antenna formed in this way has a reduced level of interference between the signals in the two crossed dipoles. Surprisingly, the antenna's ability to transmit and/or receive circularly polarized radiation is not significantly degraded by the two dipoles being non-coaxial.

Preferably, the antenna has one arm of each dipole formed from an extension of each outer conductor of its three conductor (Triplate) feed structure and each dipole is electrically connected to the central conductor of its three conductor (Triplate) feed structure which extends along the center axis of the respective dipole. Such a construction is relatively cheap and simple because it does not require the use of coaxial lines to link the three conductor (Triplate) central conductor to the dipole.

An antenna according to the invention will now be described with reference to the accompanying Figures in which:

BRIEF DESCRIPTION OF THE SEVERAL VIEWS OF THE DRAWINGS

wherein identical parts have the same reference numerals throughout.

DETAILED DESCRIPTION

Figure 1A:
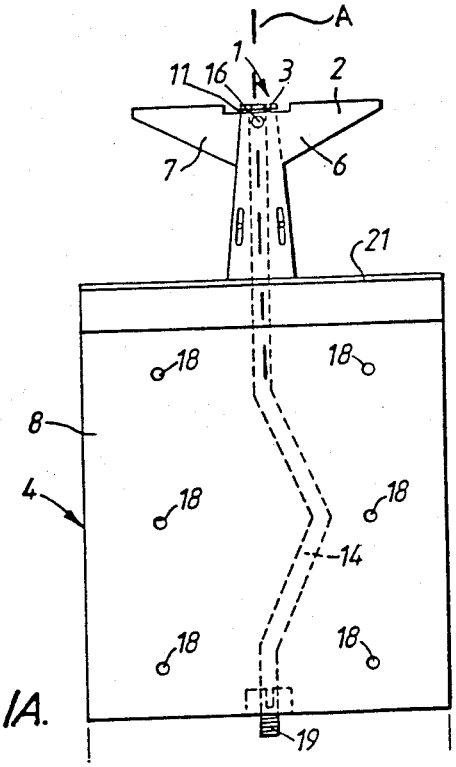
FIG. 1A shows dipoles of an antenna constructed in accordance with the invention, viewed from the side.
Figure 1B:
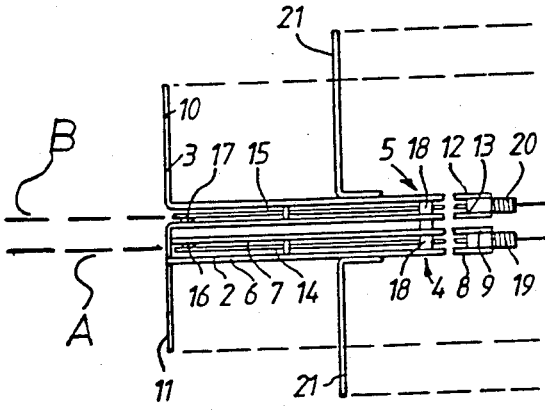
FIG. 1B shows the cross-dipole of FIG. 1A viewed from another side.
Figure 1C:
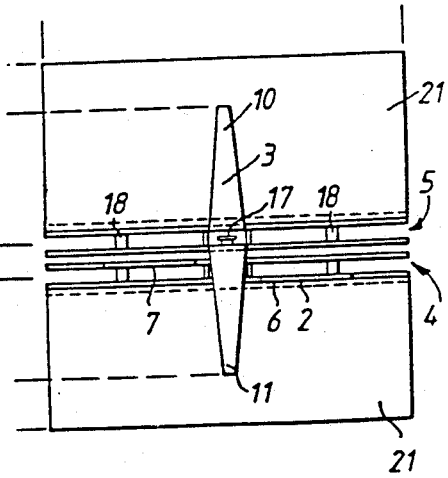
FIG. 1C shows the cross-dipoles of FIG. 1A viewed from above.
Figure 2:
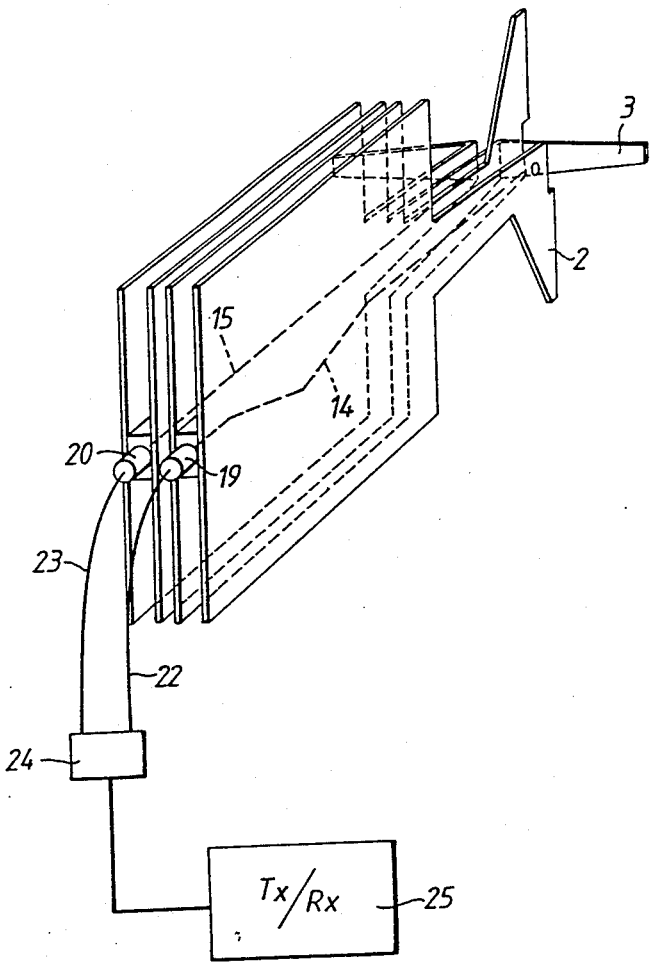
FIG. 2 shows the cross-dipole of FIG. 1A with its feed system with the ground reflector being omitted for clarity.

A cross-dipole 1 is formed by two dipoles 2 and 3. The dipole 2 is fed by a three conductor (Triplate) feed structure 4 and the dipole 3 is fed by a three conductor (Triplate) feed structure 5 (FIG. 1C). The three conductor (Triplate) feed structure 4 comprises a pair of outer conductors 8 and 9 and a central or inner conductor 14. Central or inner conductor 14 extends along center axis A of dipole 2. The three conductor (Triplate) feed structure 5 comprises a pair of outer conductors 12 and 13 and a central or inner conductor 15. Central or inner conductor 15 extends along center axis B of dipole 3.

The dipole 2 is formed from two dipole arms 6 and 7 made from extensions of the outer conductors 8 and 9 of the (Triplate) feed structure 4 respectively.

The dipole 3 is formed from two dipole arms 10 and 11 made from extensions of the outer conductors 12 and 13 of the (Triplate) feed structure 5 respectively.

The dipole arms are all approximately $\lambda/4$ in length, where $\lambda$ is the intended transmission or reception wavelength of the antenna. The two dipoles are perpendicular to one another, so by supplying them with signal 90° out of phase it is possible to transmit circularly polarized radiation.

The dipole 2 is fed from the inner conductor 14 of the (Triplate) feed structure 4, which is electrically connected to the dipole arm 6 by a conductive pin 16. Similarly, the dipole 3 is fed from the inner conductor 15 of the (Triplate) feed structure 5 which is electrically connected to the dipole arm 11 by a conductive pin 17.

The outer conductors 8 and 9 of (Triplate) feed structure 4 and the outer conductors 12 and 13 of (Triplate) feed structure 5 are all held in position by pins 18. Signals are supplied to or picked up from the inner conductor 14 of the (Triplate) feed structure 4 through a connector 19 and to or from the inner conductor 15 of the (Triplate) feed structure 5 through a connector 20. These signals are supplied to or picked up from the connectors 19 and 20 by leads 22 and 23 respectively. Leads 22 and 23 are connected together at a splitter combiner 24 and then connected to a transmit/receive system 25. Such systems are well known and need not be described in detail.

The three conductor (Triplate) inner conductors 14 and 15 are arranged so that the path length for signals passing along the inner conductor 14 between the connector 19 and the dipole 2 imposes an extra 90° phase delay compared to the path length along the inner conductor 15 between the connector 20 and the dipole 3. This phase difference allows circularly polarized radiation to be transmitted and received by the crossed-dipole 1.

A conductive ground plane 21 electrically connected to the outer conductors 8 and 12 of the (Triplate) feed structure 4 and 5 is used to provide a unidirectional radiation pattern by acting as a reflector.

The profile shown for the dipole arms 6, 7, 10 and 11 has been found to give very low levels of interference between the two dipoles, however the invention could employ dipoles having any conventional profile.

Although the phase difference between the signals supplied to the two dipoles 2 and 3 is described as being provided by the path length difference of the three conductor (Triplate) inner conductors 14 and 15, it could be provided in any other known manner, such as a delay line. Such a phase controller could be combined with the splitter/combiner 24.

The length of the dipole arms 6, 7, 10 and 11 is described as being $\lambda/4$; it could be made any integer number of $\lambda/4$, if this were preferred.

What is claimed:

1. An antenna comprising:

a pair of crossed dipoles, each dipole having a center axis and a pair of dipole arms disposed about its center axis, the pair of crossed dipoles being arranged such that the center axes are separated by a distance less than the length of the dipole arm;

two three conductor feed structures, each feed structure being connected to a respective one of said pair of dipoles and having two outer conductors and a central conductor, the central conductor extending along the center axis of the respective dipole;

wherein each arm of said pair of dipole arms of each dipole is formed from an extension of one of the two outer conductors of the feed structure connected to the respective dipole and one arm of each dipole is electrically connected to the central conductor of the feed structure connected to the respective dipole.

2. An antenna as defined in claim 1, wherein the two three conductor feed structures are parallel to one another and the dipole arms of a first one of the pair of dipoles are co-planer with the two outer conductors of its respective feed structure and the dipole arms of a second one of the pair of dipoles are perpendicular to the plane of the two outer conductors of its respective feed structure.

3. An antenna as defined in claim 1, wherein the pair of crossed dipoles are perpendicular to one another and are supplied with signals 90° out of phase to transmit circularly polarized radiation.

4. An antenna as defined in claim 1, wherein signals transmitted along one of the central conductors are delayed 90° in phase relative to signals transmitted along the other of said central conductors.

5. An antenna as defined in claim 4, wherein the phase difference between signals is provided by the signal path length of said one of the central conductors being longer than the signal path length of the other of the central conductors.

* * * * *